US009969542B2

(12) United States Patent
Deflorian et al.

(10) Patent No.: US 9,969,542 B2
(45) Date of Patent: May 15, 2018

(54) CONTAINER

(71) Applicant: ZOBELE HOLDING SPA, Trento (IT)

(72) Inventors: Stefano Deflorian, Trento (IT); Walter Sordo, Trento (IT); Livio Sordo, Trento (IT); Cedric Morhain, Barcelona (ES)

(73) Assignee: ZOBELE HOLDING SPA, Trento (IT)

( * ) Notice: Subject to any disclaimer, the term of this patent is extended or adjusted under 35 U.S.C. 154(b) by 32 days.

(21) Appl. No.: 14/899,155

(22) PCT Filed: Jun. 17, 2013

(86) PCT No.: PCT/EP2013/062487
§ 371 (c)(1),
(2) Date: Dec. 17, 2015

(87) PCT Pub. No.: WO2014/202107
PCT Pub. Date: Dec. 24, 2014

(65) Prior Publication Data

US 2016/0137376 A1 May 19, 2016

(51) Int. Cl.
*B65D 35/02* (2006.01)
*B65D 35/10* (2006.01)
(Continued)

(52) U.S. Cl.
CPC ..... *B65D 75/585* (2013.01); *B65D 75/5838* (2013.01); *B65D 81/3294* (2013.01); *B65D 75/367* (2013.01); *B65D 81/3266* (2013.01)

(58) Field of Classification Search
CPC ..... B65D 81/3266; B65D 75/585; B65D 75/5838; B65D 81/3294; B65D 2575/367;
(Continued)

(56) References Cited

U.S. PATENT DOCUMENTS 3,412,907 A * 11/1968 Faso ..... A45D 34/02 222/187
3,472,368 A * 10/1969 Hellstrom ..... B65D 75/32 206/469

(Continued)

FOREIGN PATENT DOCUMENTS

DE 102004007276 A1 10/2005
WO WO-98/54065 A1 12/1998

OTHER PUBLICATIONS

"Capillarity". Encyclopædia Britannica. Encyclopædia Britannica Online. Encyclopædia Britannica Inc., 2017. Web. Mar. 14, 2017 <https://www.britannica.com/science/capillarity>.*

(Continued)

*Primary Examiner* — J. Gregory Pickett
*Assistant Examiner* — Gideon Weinerth
(74) *Attorney, Agent, or Firm* — Marshall, Gerstein & Borun LLP

(57) ABSTRACT

The container comprises a chamber closed by a flexible cover, and it is characterized in that said flexible cover defines a weakened area forming a seal between the chamber and the flexible cover, and in that the container comprises bending means for bending this weakened area so that the flexible cover separates from the chamber at the weakened area, opening said chamber.

The container has the main advantage that it can be opened easily, just acting on the bending means.

9 Claims, 2 Drawing Sheets

(51) Int. Cl.

| | |
|---|---|
| ***B65D 35/08*** | (2006.01) |
| ***B65D 75/60*** | (2006.01) |
| ***B65D 75/28*** | (2006.01) |
| ***B65D 75/58*** | (2006.01) |
| *B65D 75/36* | (2006.01) |
| *B65D 81/32* | (2006.01) |

(58) Field of Classification Search

CPC .. B65D 75/328; B65D 75/368; B65D 75/367; B65D 2575/3254; B65D 2221/00; B65D 2231/02; B65D 2231/005; Y10S 206/824

USPC ..... 428/35.2, 35.3; 229/270, 4.21–4.23; 222/541.01, 94, 541.6; 206/219, 469, 206/428, 604, 222, 531, 532; 410/132, 410/133, 196

See application file for complete search history.

(56) References Cited

U.S. PATENT DOCUMENTS 3,521,805 A * 7/1970 Ward ..... B65B 29/10 206/484
3,689,458 A * 9/1972 Hellstrom ..... B65D 75/32 206/530
3,948,394 A * 4/1976 Hellstrom ..... B65D 75/326 206/520
3,986,640 A * 10/1976 Redmond ..... B65D 75/30 206/469
4,140,409 A * 2/1979 DeVries ..... A45D 34/04 401/132
4,493,574 A * 1/1985 Redmond ..... B65D 75/368 206/469
4,611,715 A * 9/1986 Redmond ..... B65D 75/368 206/469
4,724,982 A * 2/1988 Redmond ..... B65D 75/367 206/469
4,790,429 A * 12/1988 Fukushima ..... B65D 81/3294 206/219
4,903,842 A * 2/1990 Tokuda ..... B32B 27/06 206/222
5,316,400 A * 5/1994 Hoyt ..... A47L 13/17 206/469
5,395,031 A * 3/1995 Redmond ..... B65D 75/367 206/469
5,518,790 A * 5/1996 Huber ..... A61L 9/12 206/484
6,360,916 B1 * 3/2002 Sokolsky ..... B65D 75/5822 222/107
6,695,515 B1 * 2/2004 Fleury ..... A61F 17/00 401/132
6,722,578 B2 * 4/2004 Skalitzky ..... A61L 9/03 239/53
7,644,821 B2 * 1/2010 Perell ..... B65D 75/328 206/469
7,926,735 B1 * 4/2011 Mobley ..... A61L 9/04 206/449
2006/0283727 A1 * 12/2006 Nelson ..... B65B 61/02 206/219
2007/0125667 A1 * 6/2007 Lee ..... B65D 75/5805 206/219
2007/0138204 A1 * 6/2007 Chen ..... A45D 34/04 222/145.1
2009/0114677 A1 * 5/2009 Stuart ..... B65D 75/5811 222/94
2010/0065582 A1 * 3/2010 Nelson ..... B65B 61/02 222/107
2011/0086141 A1 4/2011 Strilich et al.
2011/0167570 A1 * 7/2011 Littig ..... B65D 75/366 8/137
2012/0223099 A1 * 9/2012 Sanchez ..... B65D 75/585 222/103
2014/0048614 A1 * 2/2014 Santini ..... A61L 9/122 239/6
2014/0209698 A1 * 7/2014 Olchovy ..... A61L 9/12 239/6
2014/0209700 A1 * 7/2014 Olchovy ..... A61L 9/12 239/34
2016/0137376 A1 * 5/2016 Deflorian ..... B65D 75/5838 220/270

OTHER PUBLICATIONS

International Search Report issued in PCT/EP2013/062487 dated Apr. 9, 2014.

* cited by examiner

CONTAINER

CROSS-REFERENCE TO RELATED APPLICATIONS

This U.S. utility patent application is a national stage application under 35 U.S.C. § 371 of international application PCT/EP2013/062487, filed Jun. 17, 2013, the entire contents of which are hereby incorporated herein by reference for all purposes.

TECHNOLOGICAL FIELD

The present disclosure refers to a container, comprising a weakened area that permits an easy opening just applying a bending stress.

BACKGROUND

Several kinds of easy opening containers are well known in the art, including containers that are opened pressing on the container (WO2004039694—VALOIS; EP1542612—VOCO), containers that are opened pushing on a solid substrate inside the seal towards the seal (US2004112769—ACCANTIA; EP1021356—Klocke), and container that have a cut that is extended by twisting (see U.S. Pat. No. 8,069,985—Easypack).

These kinds of containers have several drawbacks.

The containers in which the opening is based on pressing on them or generating pressure inside the container by any means are quite hard to open, because the user has to compress the container and it can be damaged. In addition, the inner pressure is related with the chemical product contained, the level of filling, the atmospheric pressure when container was sealed. All these parameters affect robustness of the process of aperture of the container.

The containers in which the opening is base on pushing a substrate require having a solid substrate inside it.

The containers provided with a cut have problems regarding its barrier property and they are also hard to activate. Furthermore, the cut might be extended in such a way that the sealing assured on the border of the container is potentially lost.

Therefore, it is clear that there is a need for a container that can be opened easily and that does not have said drawbacks.

SUMMARY

The presently described container resolves the aforementioned drawbacks, presenting other advantages that will be described hereinafter.

The container of the present disclosure comprises a chamber closed by a flexible cover, and it is characterized in that said flexible cover defines a weakened area forming a seal between the chamber and the flexible cover, and in that the container comprises bending means for bending this weakened area so that the flexible cover separates from the chamber at the weakened area, opening said chamber.

According to an embodiment, the container comprises two chambers, said weakened area joining said two chambers, so that when the weakened area is bent the flexible cover opens the communication between the chambers at the weakened area.

In an embodiment, the flexible cover comprises a barrier layer and this barrier layer is sealed at the weakened area.

According to an embodiment, the thickness of the weakened area changes along its length, and the width of the weakened area changes along its length, so that the zone with a smaller thickness of the weakened area coincides with the zone with a smaller thickness of the weakened area.

In an embodiment, the flexible cover also comprises a cover layer, and there is access between one of said chambers and said cover layer, said access being a hole at said barrier layer.

Said cover layer is made from a material with a high capillarity, in an embodiment, and said cover layer is sealed to the barrier layer only at its perimeter.

According to an embodiment, said bending means comprises a pair of flexible tabs placed at two opposed sides of the weakened area.

In an embodiment, said flexible cover comprises side extensions corresponding with the flexible tabs.

According to an embodiment, one of said chambers is an evaporation chamber and said cover layer is a semipermeable membrane.

The container of the present disclosure has the main advantage that it can be opened easily, just acting on the bending means.

BRIEF DESCRIPTION OF THE DRAWINGS

For a better comprehension of what has been disclosed, some drawings are attached in which, diagrammatically and only as a non-limitative example, a practical embodiment is shown.

DESCRIPTION OF A PREFERRED EMBODIMENT

Figure 1:
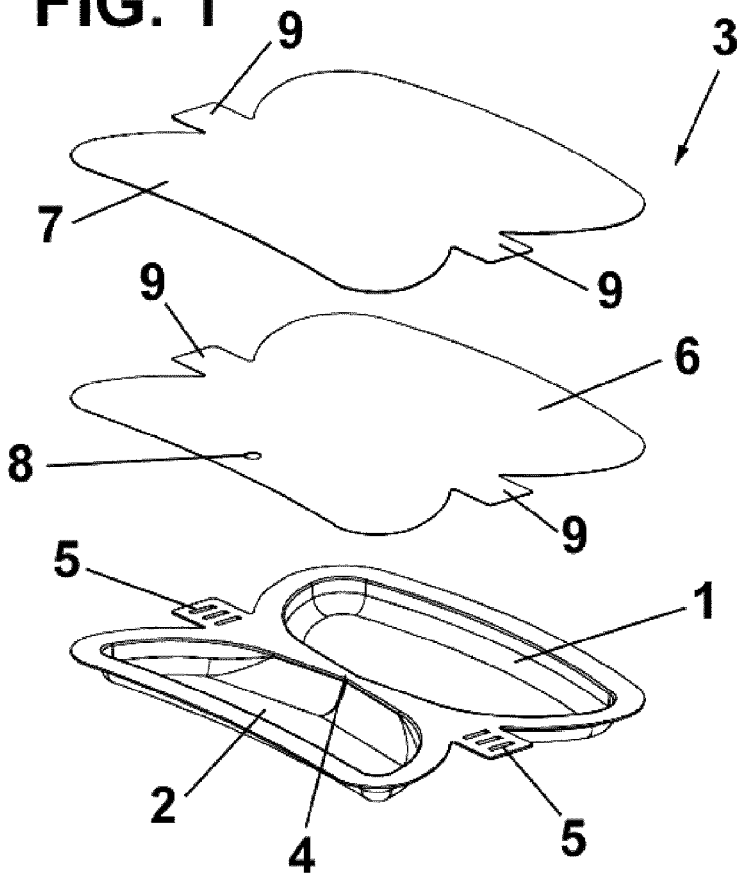
FIG. 1 is an exploded perspective view of the container according to an embodiment.
Figure 2:
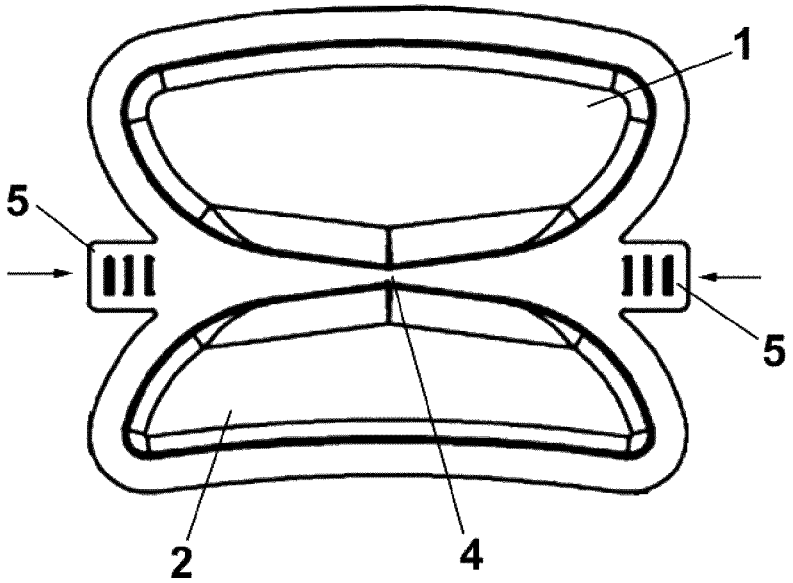
FIG. 2 is a plan view of the container according to the embodiment.

In the drawings an embodiment of the container is shown.

According to this embodiment, the container comprises two chambers 1, 2 and a flexible cover 3 that closes said two chambers 1, 2.

Even though the container of this embodiment comprises two chambers, it must be pointed out that in other embodiments the container can also comprise just one chamber.

The flexible cover 3 defines a weakened area 4 between the chambers 1, 2 and the flexible cover 3. This weakened area 4 is associated with bending means, which in the case of the embodiment shown is a pair of tabs 5. In this case, said flexible cover 3 comprises side extensions 9 corresponding with the flexible tabs 5.

According to an embodiment, the thickness of the weakened area 4 changes along its length, and the width of the weakened area 4 changes along its length, so that the zone with a smaller thickness of the weakened area 4 coincides with the zone with a smaller thickness of the weakened area 4.

This tabs 5 are flexible and are placed at opposed sides of the weakened area 4, so that when the tabs 5 are pressed one to each other, the weakened area 4 flexes and the flexible cover 4 separates from the weakened area 4, so that the two chambers 1, 2 are communicated to each other and, for example, two substances in the two chambers can be mixed together.

Figure 3:
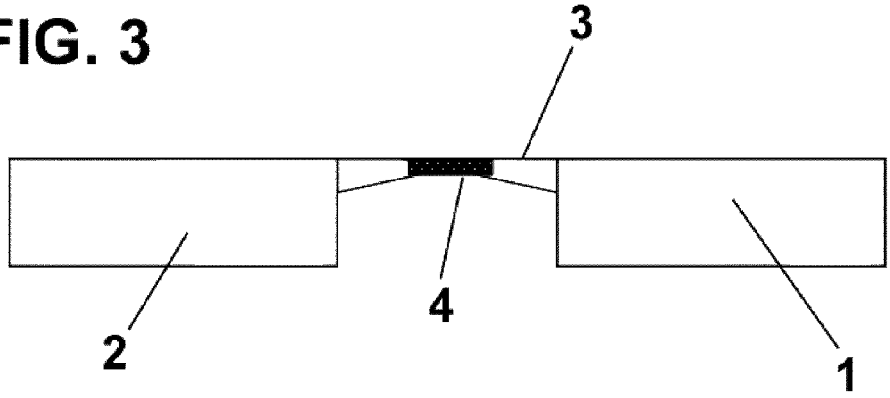
FIG. 3 is a diagrammatical section view of the container wherein the communication between the two chambers is sealed.
Figure 4:
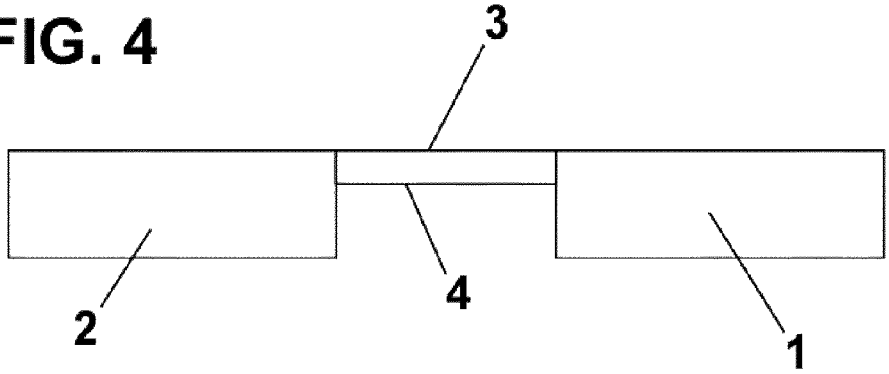
FIG. 4 is a diagrammatical section view of the container after opening the communication between the two chambers.

FIGS. 3 and 4 show the sealing between the two chambers 1, 2 before these tabs 5 are pressed and after pressing them, respectively.

Before the tabs 5 are pressed the communication between the chambers 1, 2 is sealed. When the tabs 5 are pressed the seal is broken and the communication between the chambers 1, 2 remains open.

In the case the container comprises just one chamber 1, pressing the tabs 5 one to each other, the flexible cover 4 separates from the chamber 1 at the weakened are 4, opening the container directly outside.

In embodiments, the flexible cover 4 is welded on the periphery of the chamber or chambers 1, 2, and the weakened area 4 is a zone in which the welding is narrower than in the rest of the periphery of the chamber or chambers. It is clear that the chambers can be shaped differently and that the gradient of the width of the welding can have different profiles, such as triangular or elliptical.

The flexible cover 4 can be made from a single layer or from several layers. According to the embodiment shown, the flexible cover 4 is made from two layers: a cover layer 7 and a barrier layer 6.

If the cover layer 7 is a semipermeable membrane, one of the chambers 2 is an evaporation chamber, so that a volatile substance, such as a fragrance or insecticide formulation, will be emanated from the membrane. In this case, the container can be used in combination with a heater or a fan. Also in this case, the barrier layer 6 can be provided with a hole 8 at the second chamber 2, so that once the communication between the two chambers is opened, the hole 8 will provide a passage for the liquid from the chambers to the membrane o cover layer 7.

Regarding the materials, the material of the chambers 1, 2 is preferably in the range of thickness between 200 and 700 microns, preferably between 300 and 500 microns.

The chambers 1, 2 are made from a structural material that provides the mechanical features of the container, preferably PP or PET.

The flexible cover 3 that is in contact with the chamber or chambers is made from a material suitable to allow effective welding, preferably PE.

If a barrier layer 6 is used to increase the barrier features of the container, this barrier layer is preferably made from EVOH.

The cover layer 7 has a thickness between 20 and 200 microns, preferably between 50 and 80 microns. It is made from a material having a partial compatibility with the barrier layer 6 of the container.

For example, if the chamber or chambers are done from PE, the barrier layer 6 can made from PP, but it also it can be of PE mixed with a second plastic incompatible with PE, like polybutadiene.

Of course, the construction of the flexible cover 3 can be also made in the reverse way, having PE on the cover layer 7 and partially compatible material at the barrier layer 6 of the flexible cover. In this case, the barrier layer 6 that can be made preferably from aluminum. Alternatively, it could be a barrier layer 6 made from EVOH or PVDF.

Even though reference is made to a specific embodiment, it is clear for a person skilled in the art that the disclosed container is susceptible of variations and modifications, and that all the details cited can be substituted by other technically equivalent ones, without departing from the scope of protection defined by the attached claims.

The invention claimed is:

1. A container comprising:

two chambers located at opposite ends of a first axis of the container;

a peripheral rim defining a topmost lateral surface of the container;

a flexible cover detachably sealed to the two chambers at the peripheral rim;

and two bending tabs located between the two chambers at opposite ends of a second axis of the container that is perpendicular to the first axis, wherein the peripheral rim narrows to a weakened area at the intersection of the two axes between the two chambers and in line with the two bending tabs, whereby when a user applies pressure to the two bending tabs, the flexible cover separates from the peripheral rim at the weakened area to open a communication channel between the two chambers.

2. A container according to claim 1, wherein the flexible cover comprises a barrier layer and this barrier layer is sealed at the weakened area.

3. A container according to claim 1, wherein the flexible cover comprises a cover layer.

4. A container according to claim 1, wherein the flexible cover comprises a cover layer, and wherein there is access between one of said two chambers and said cover layer.

5. A container according to claim 2, wherein the flexible cover comprises a cover layer, wherein there is access between one of said two chambers and said cover layer, and wherein said access is a hole at said barrier layer.

6. A container according to claim 2, wherein the flexible cover comprises a cover layer, and wherein said cover layer is sealed to the barrier layer only at its perimeter.

7. A container according to claim 1, wherein said flexible cover comprises side extensions corresponding with the flexible tabs.

8. A container according to claim 1, wherein one of said two chambers is an evaporation chamber.

9. A container according to claim 3, wherein said cover layer is a semipermeable membrane.

* * * * *